US006168497B1

(12) United States Patent
Edmond

(10) Patent No.: US 6,168,497 B1
(45) Date of Patent: Jan. 2, 2001

(54) COMBINATION SUPPORTING BRA AND POUCH COVER LINING FOR A COMMERCIAL BREAST PROSTHESIS

(76) Inventor: Vita Joann Edmond, 218 N. Charles St., Baltimore, MD (US) 21201

( * ) Notice: Under 35 U.S.C. 154(b), the term of this patent shall be extended for 0 days.

(21) Appl. No.: 09/150,929

(22) Filed: Sep. 10, 1998

(51) Int. Cl.[7] ..... A41C 3/08
(52) U.S. Cl. ..... 450/30; 450/1
(58) Field of Search ..... 450/1, 30, 31, 450/32, 39, 54, 55, 57, 66; 623/7, 8

(56) References Cited

U.S. PATENT DOCUMENTS 1,845,011 * 2/1932 Yerkes ..... 450/54
3,173,420 * 3/1965 Mazzoni et al. ..... 450/58
4,100,621 * 7/1978 Ettipio ..... 2/114

OTHER PUBLICATIONS

Gershman, Mauric, "Self Adhering Nylon Tapes," vol. 168, No. 7, p. 930, Oct. 1958.

* cited by examiner

*Primary Examiner*—Gloria M. Hale

(57) ABSTRACT

An elasticized stretchable sport bra type bra with molded cups and pouch linings that hold commercial breast prosthesis. The bra cup has the loop side and the frontal piece of the pouch lining has the hook side of the closures, strategically placed and sewn to the them. The back piece of the pouch has a slip opening, for the insertion of a commercial breast prosthesis. The combination pouch lining and prosthesis are then inserted into the bra cups to the corresponding closures the combination allows the prosthesis to stay in place and take on the form of the bra cups.

3 Claims, 6 Drawing Sheets

Inside View Combination Supporting Bra and Pouch Cover Lining Joined at Strategic Closure Points Inside view of ouch Cover Lined Prosthesis Attached to Bra Closures

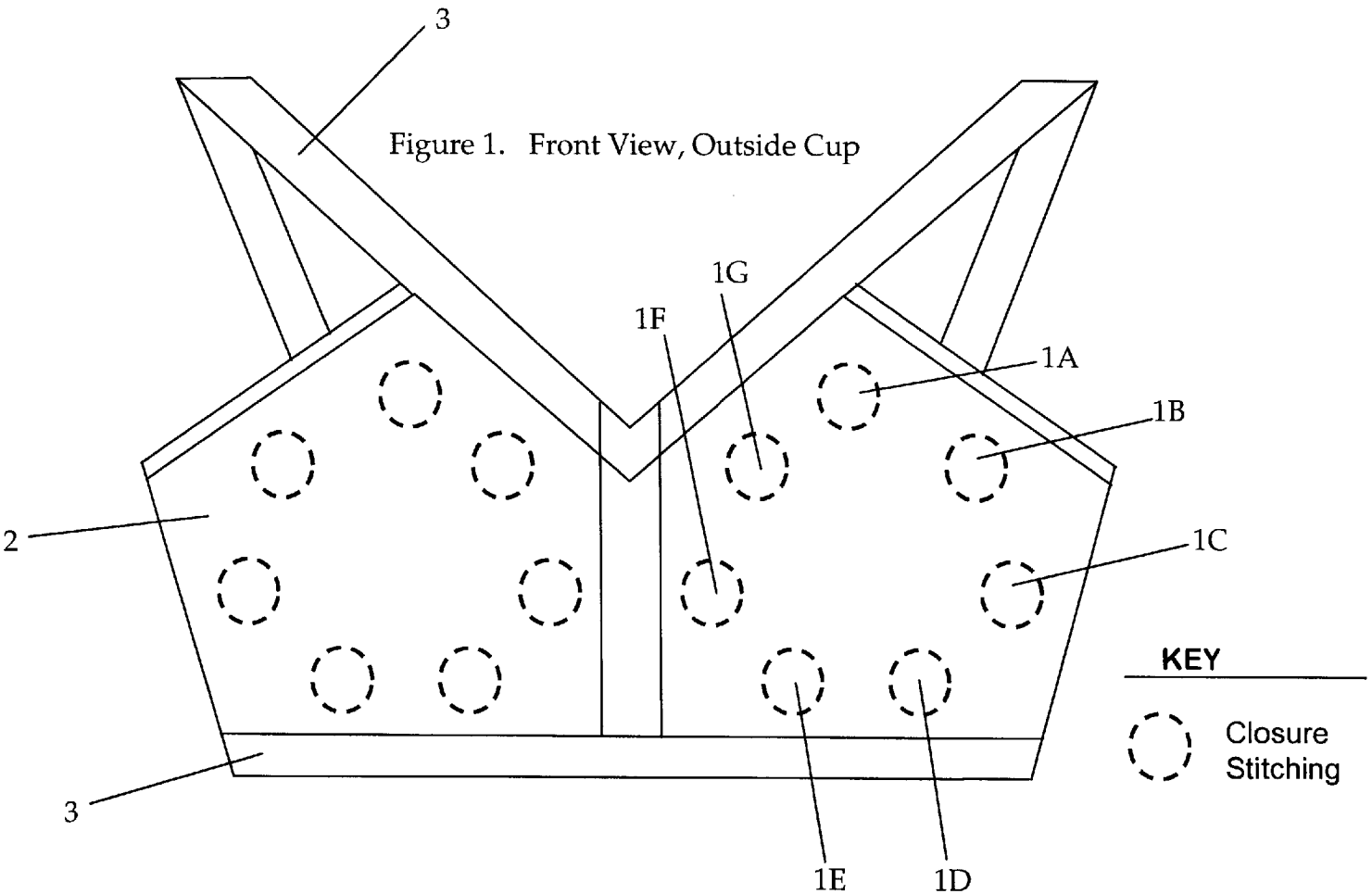
Figure 1. Front View, Outside Cup
Outside Front View of Stitched Loop Side Velcro Sewn Inside of Bra

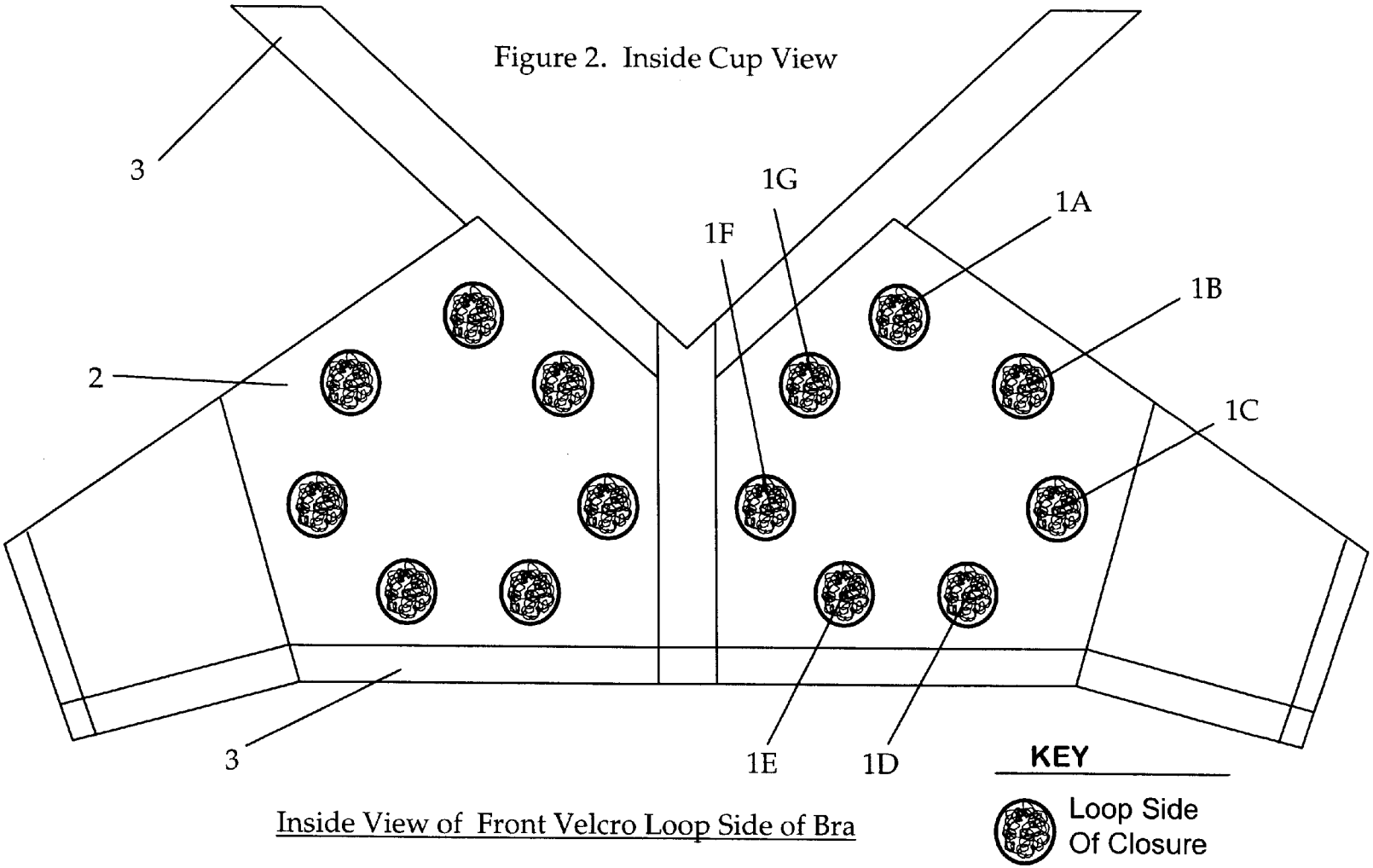
Figure 2. Inside Cup View

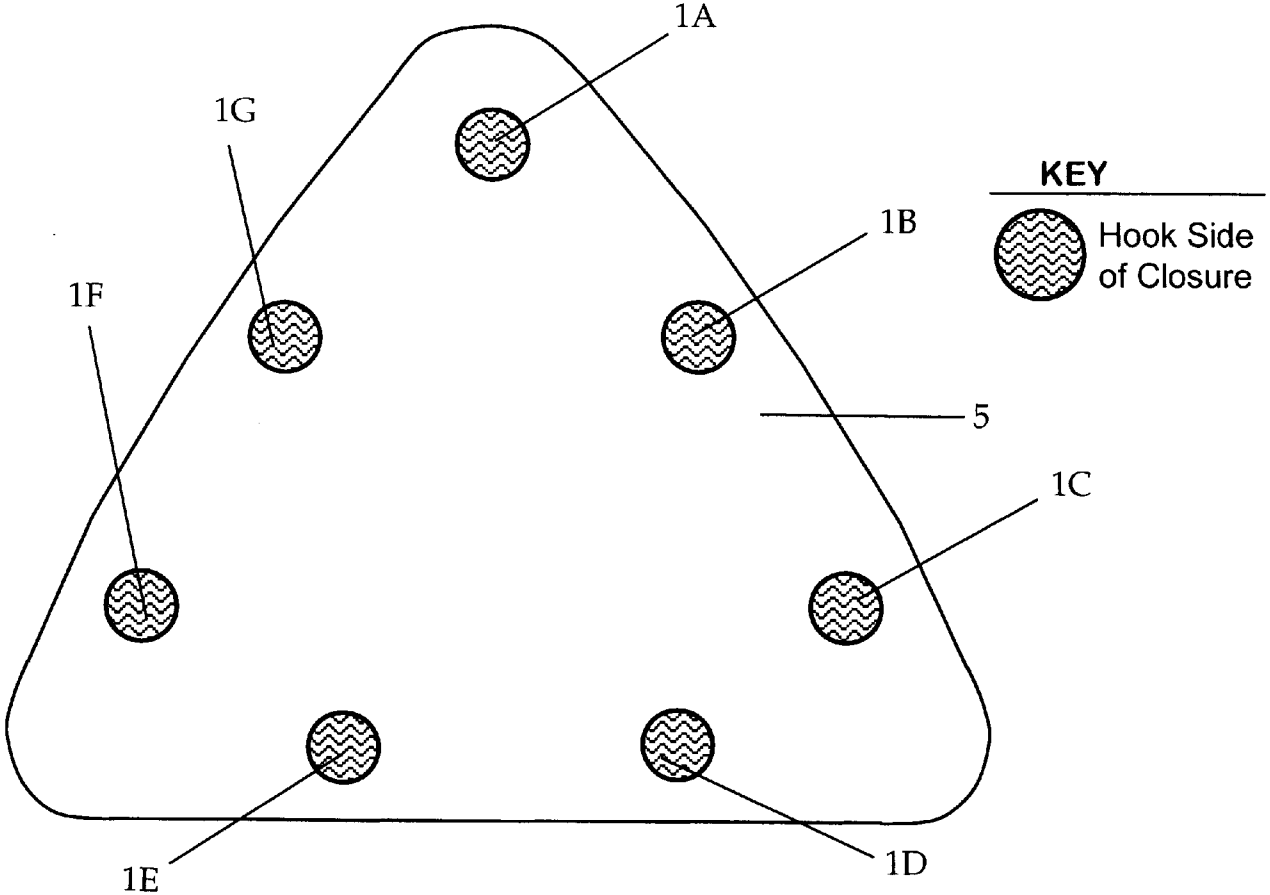
Figure 3._Lined, Covered Prosthesis View
Front Hook Side Velcro Closure Pouch Covered Prosthesis

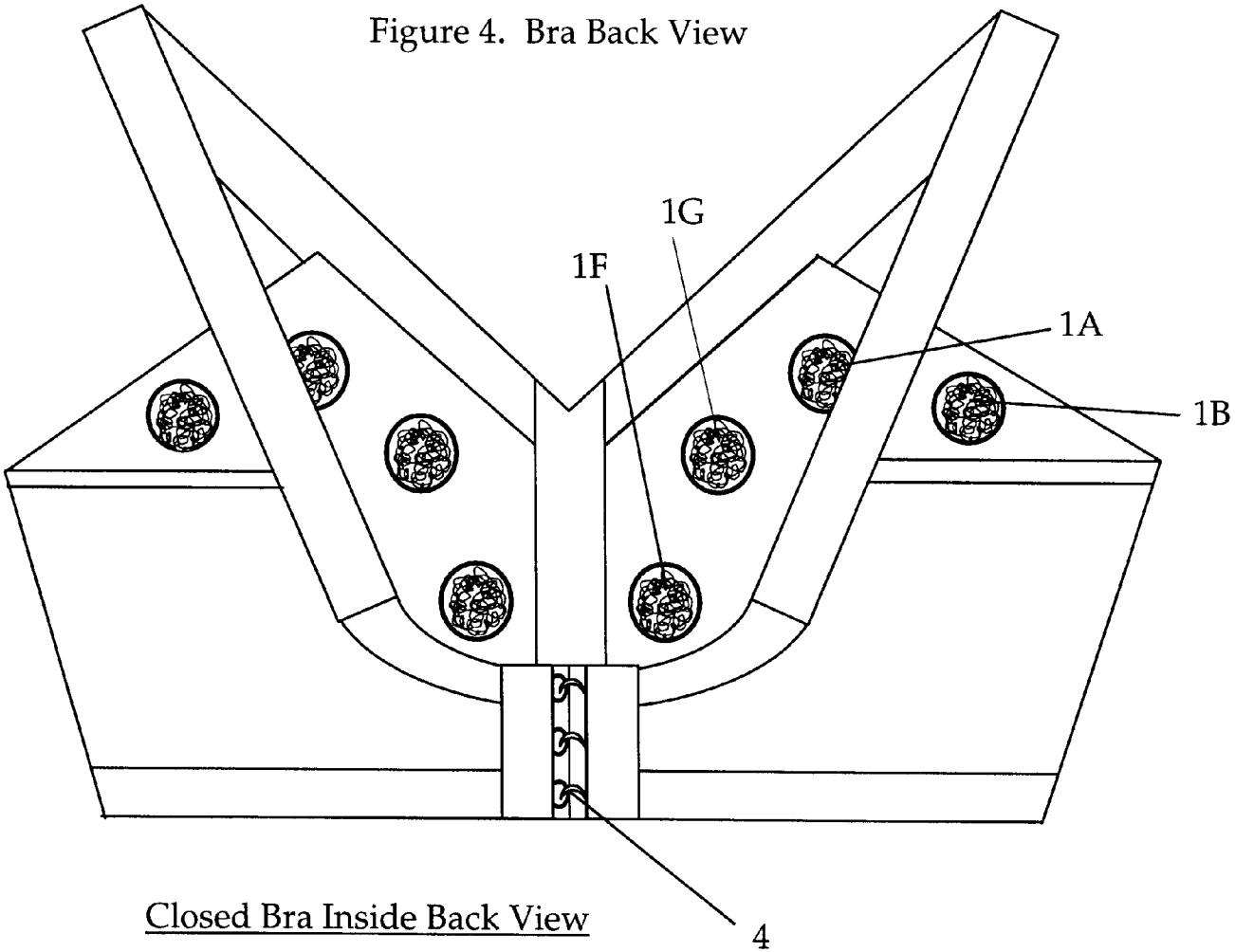
Figure 4. Bra Back View

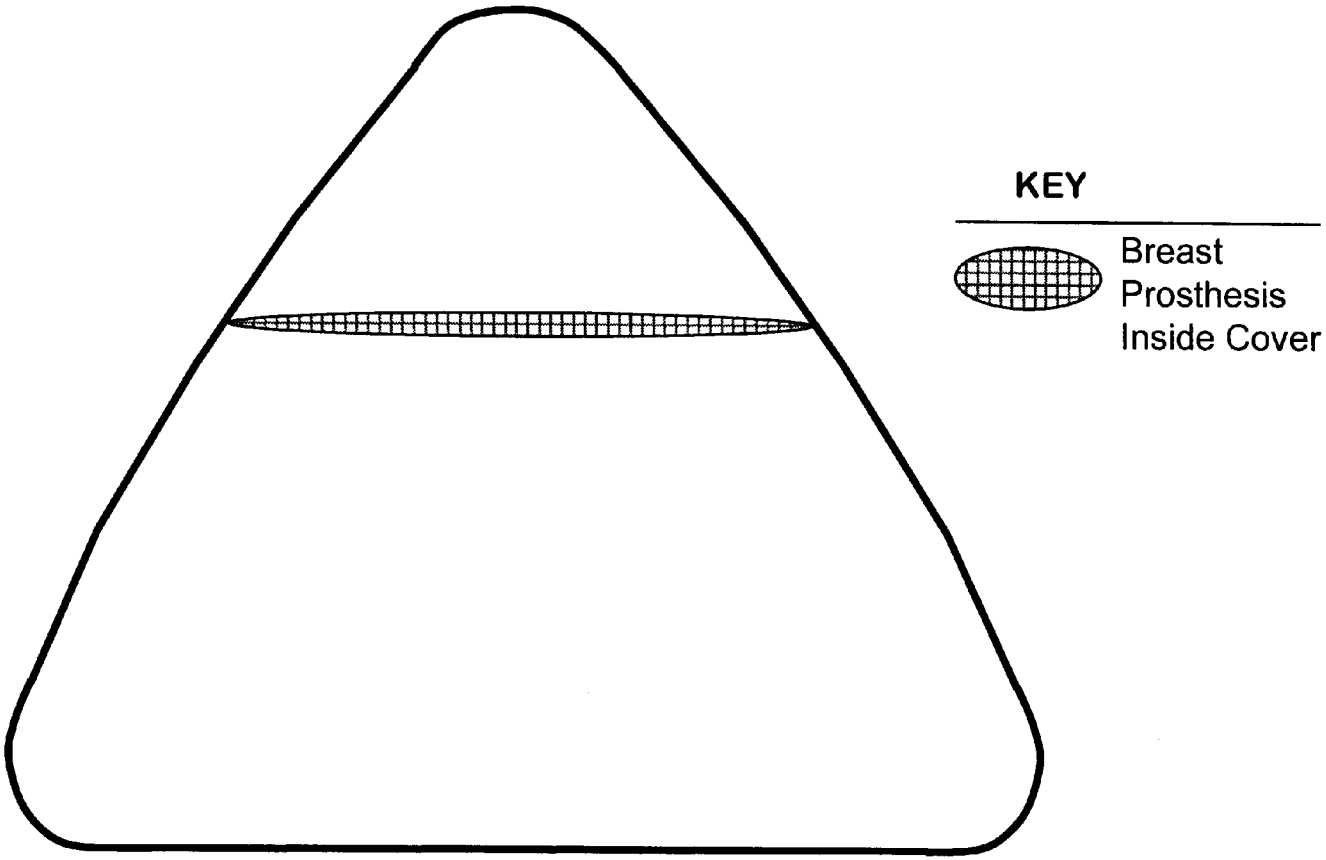
Figure 5. Back View of Covered Breast Prosthesis

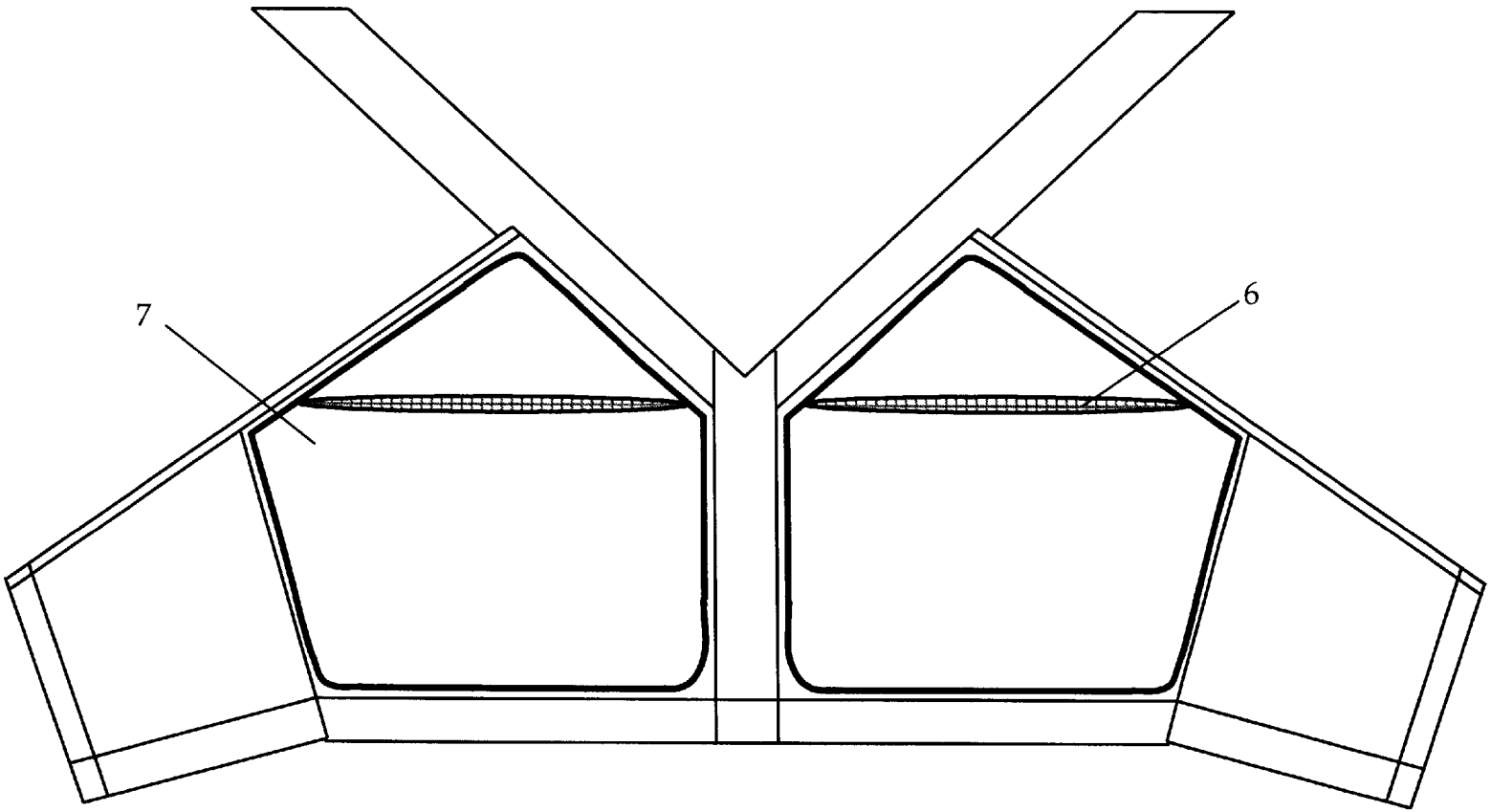
Figure 6. Inside View Combination Supporting Bra and Pouch Cover Lining Joined at Strategic Closure Points
Inside view of ouch Cover Lined Prosthesis Attached to Bra Closures

COMBINATION SUPPORTING BRA AND POUCH COVER LINING FOR A COMMERCIAL BREAST PROSTHESIS

BACKGROUND

1. Field of the Invention

This invention relates to a molded cup type Sports Bra type (trade name) stretch bra undergarment and pouch cover lining for breast prosthesis, with cut Velcro® (trade name) closures specifically to such materials which are for a cover foam breast prosthesis, and supporting bra.

2. Description of Related Art

The present combination breast prosthesis and bra, are heavy silicon prostheses with pockets sewn in the bra cup. Or a heavy silicon prosthesis attached to the skin with adhesive tape and velcro, to be worn with pocket sewn bra cups. The silicon prosthesis is heavy, doesn't stay in a place cup. It pulls the shoulder forward, it is uncomfortable, and occasionally loses its firmness in hot and humid temperature. A covered foam prosthesis unlike a silicon prosthesis is light weight and comfortable. But it moves in the pocket as does the silicon prosthesis when the body is in motion. Therefore, the total support is unnatural, uncomfortable, and heavy as in the case of the silicon prosthesis.

OBJECTS AND ADVANTAGES

The purpose of this invention is to provide comfort, natural support and a natural bust line.

(a) To provide a natural bust line under all clothing.

(b) To provide a light weight natural support.

(c) To provide a natural balance to the body.

(d) To provide a supporting bra that is stable with physical movement.

(e) To provide a prosthesis that doesn't slip and slid with body movement.

(f) To provide a prosthesis that maintains its form in all temperatures.

(g) To provide an alternative to pocket lined supporting bras.

(h) To provide more self-esteem and freedom to the wearer.

(i) To provide a wearer more possibilities for active sports (aerobics, running, etc.)

(j) To provide for a left side, right side or both breast prosthesis wearer.

(k) To provide an alternative to the old fashion bra and prosthesis.

(l) To provide a younger looking bra and prosthesis to the wearer.

Further advantages are easy and inexpensive manufacturing. The loop side of the closure is sewn on by an embroidery type machine. Used for applications of this type, before the bra is sewn together and the cups are molded. The same embroidery machine is used to sew the hook sides of the closure to the front of the pouch lining covering of the breast prosthesis. It gives a contemporary and modern appearance to a growing population of women of all ages, who have to wear a prosthesis and supporting bra.

DRAWINGS AND FIGURES

Referring to a better understanding of my invention. I am showing an elastic bra type with seven loop side Velcro® closures, sewn inside the molded bra cup and pouch lining with corresponding hook side closures for a commercial breast prosthesis.

FIG. 1 frontal view of bra and how the closures appear when sewn into the bra cup at the front FIG. 2 inside of molded bra cup and loop side of the closures sewn in FIG. 3 anatomic frontal view of pouch lining and hook side of closures FIG. 4 back view of closed bra with loop closures FIG. 5 back covered pouch lining with the prosthesis inserted FIG. 6 inside view of a prosthesis inserted in pouch lining and attached to molded bra cup

REFERENCE NUMERALS IN DRAWINGS

Bra

1*a*–1*g* loop side of closure

2 elasticized stretched molded bra cups and bra fabric

3 elastic trim

4 bra closure

Pouch Cover Lining for Prosthesis

1*a*–1*g* hook side of closure

5 elasticized stretched anatomic pouch cover lining covering commercial prosthesis inside

6 back opening insertion of commercial prosthesis

7 back pouch lining

SUMMARY OF THE INVENTION

Therefore, a molded elasticized sport type bra cup is stretched over the covered prosthesis and corresponding Velcro® sides are joined together. By stretching the molded sport bra cup over the covered prosthesis, the Velcro® and elasticity of the bra fabric keep the prosthesis stable. Furthermore, the bra prosthesis combination is stretched again when putting on the bra, to keep the bra from moving while on the body. Therefore, molding the natural breast, if one exists, to the same shape as the prosthesis and combination said a bra cup. If no breasts exist, the combination sport bra type and covered prosthesis equally forms a natural bust line on the body. Thus, forming a natural light weight non-artificial looking comfortable bust line. Accordingly, the wearer is comfortable and assured that the prosthesis will stay in place. The shape of the bust line will appear natural with close-fitting clothing, or alone without clothing. Thus, giving the wearer more confidence, femininity and self-esteem.

DETAILED DESCRIPTION OF THE INVENTION AND PREFERRED EMBODIMENTS

FIG. 2 (inside view), shows molded cups 2, with several loop side Velcro® closures sewn in key strategic places 1*a*–1*g*, on the inside of breast side of the bra.

FIG. 3 (frontal view) pouch cover lining shield, preferably of the same fabric as bra or of lighter weight, soft, stretchable materials for a commercial breast prosthesis, with a hook side of Velcro® sewn to the anatomic cut front piece of the pouch, at corresponding strategic points to be joined, adhesives or connected to a molded bra cup, with a breast prosthesis inserted inside.

FIG. 5 is the connecting back piece of the cover 7 sewn to the anatomic cut frontal piece at the outer sides to form a pouch for prosthesis lining cut flat to give an anatomic shape when joined to the front piece 5. Item 6 shows a slit, the buttonhole like pouch opening for the insertion of the prosthesis, preferably near the top part as the prosthesis is generally flatter at this part, and it would be easier for the opening to stay closed.

FIG. 6 is the inside view, skin side of the prosthesis inserted in the covered lining and attached, to the bra cup by stretching the molded bra cup over the covered prosthesis joining it to the strategic connecting parts. Therefore, item 6 is the slit buttonhole like pouch opening and 7 is the back of the pouch lining, that goes next to the skin over the surgical cut where the breasts once were.

FIG. 1 shows the frontal view of the bra with and without the joining pouched-covered prosthesis, and stitches, places or sewn points of the strategically positioned loop side of the closures inside preferably in the same color thread as the bra.

FIG. 4 shows the inside view of the bra closed at the back without a covered prosthesis.

A commercial simulated breast prosthesis, preferably of a soft, flexible, moldable material is inserted in the opening 6 of the anatomic shape pouch lining FIGS. 3, 5 and the elasticized stretchable molded bra cup 2 with strategically sewn closure points, 1*a*–1*g*, is pulled, stretched, joined, connected to the frontal part of the cover 5 at the strategically placed corresponding hook sides of the closures 1*a*–1*g*.

If only one breast needs a prosthesis, the same operations are applied to the single breast and the natural breast goes in the free, empty, bra cup, both simulated breast and the natural breast will take on the shape of the molded bra cup. When the wearer stretches the bra the bra is pulled closed. Thus, forming a more balanced but point and firmer breast, that move with the body.

While the invention has been described with reference to specific embodiments thereof, it will be appreciated that numerous variations, modification and embodiments are possible and accordingly all such variations, modification and embodiments are to be regarded as being with the spirit and scope of the invention for example, a sports bra type, underwire, shelf bra or separated bra, front closure, adjustable straps, strapless, body bra or commercial prosthesis that it will hold. A pouch lining can be sewn to a commercial prosthesis or separated inserting the prosthesis in the pouch. It is preferable that separate pouches are coupled with the bra for both cups as the combination preferably goes together.

A sports bra type bra is critical since the sports bra was developed to keep the breast from moving while doing sport activities like running, aerobics, jumping, etc. The construction of the sports bra has been developed for these means such as firm elasticized stretchable fabrics, firmer thicker elastic trims, molded shaped breast cups, higher front and back closures and shorter straps including adjustable straps stabilizing the breast from movement.

Thus, my combination sports bra type bra and pouch linings for commercial prosthesis are younger, contemporary and modern for the wearer. It is comfortable because the simulated breast feels more like a part of the body, it moves with the wearer, and doesn't separate, or detach from the body permitting the wearer to wear closer fitting garments. When worn alone, it can appear like a swimsuit bra top. Sports can be performed easier and more comfortably giving the wearer more self-confidence and self-esteem, during this troubled difficult time period with their body.

What is claimed is:

1. A sports bra assembly for use with a breast prosthesis member, the sports bra assembly comprising:

a sports bra including first and second bra cup portions;

said breast prosthesis member including a prosthesis housed within an outer lining, said prosthesis member including a front side to be adjacent one of said cup portions of said bra and a rear side to be adjacent the body of a user wearing the bra assembly, and wherein said breast prosthesis member is of a size corresponding to a size of at least one of said bra cup portions;

wherein said bra cup portions and said outer lining of said breast prosthesis member are each being made of stretchable elasticized fabric so that said one bra cup portion can be stretched over said prosthesis member;

and wherein said outer lining on the front side of said prosthesis member includes a plurality of hook and loop fasteners disposed thereon in spaced relation to one another, and said at least one bra cup portion includes a plurality of hook and loop fasteners disposed on an inner surface thereof so that hook and loop fasteners on said prosthesis member correspond to hook and loop fasteners on said at least one bra cup portion so that said prosthesis member is secured within said at least one bra cup portion of said sports bra.

2. The sports bra assembly of claim 1, wherein said outer lining of said prosthesis member includes a slit at the rear side of said prosthesis member, said slit for enabling said breast prosthesis to be inserted into said outer lining.

3. The sports bra assembly of claim 2, wherein said outer lining includes a frontal piece sewn to a back piece around a side portions of said prosthesis member.

* * * * *